US005987899A

United States Patent [19]

Kiss

[11] Patent Number: 5,987,899

[45] Date of Patent: Nov. 23, 1999

[54] PROCESS FOR COOLING LIQUID MELT DURING THERMAL WASTE TREATMENT

[75] Inventor: Günter H. Kiss, Minusio, Switzerland

[73] Assignee: Thermoselect AG, Liechtenstein, Germany

[21] Appl. No.: 08/448,918

[22] Filed: May 25, 1995

[30] Foreign Application Priority Data

Jun. 10, 1994 [CH] Switzerland ..... 44 20 415

[51] Int. Cl.[6] ..... F25D 17/02

[52] U.S. Cl. ..... 62/64; 62/78

[58] Field of Search ..... 62/62, 63, 64, 62/78

[56] References Cited

U.S. PATENT DOCUMENTS 4,704,873 11/1987 Imaike et al. ..... 62/78
5,475,984 12/1995 Fermani et al. ..... 62/64

FOREIGN PATENT DOCUMENTS 429554 5/1926 Germany .
1113535 9/1961 Germany .
4117444 3/1992 Germany .

OTHER PUBLICATIONS

Von R. Dolezal, Ostrava, Rückgewinnug der Schlackenwarme über Verdampfung, Feb., 1958.

*Primary Examiner*—Ronald Capossela
*Attorney, Agent, or Firm*—Howard & Howard

[57] ABSTRACT

A process for the discharge of melted liquid material, heated to a high temperature, which occurs during the thermal treatment of waste by direct melting or the melting down of residues. The liquid melted phases are sprayed into a jet of cooling agent with a high rate of flow and cooled until they solidify and are then passed into a water bath as a granulate. The temperature of the water bath is stabilized by the circulation of liquid, the residual heat given off, the result of further cooling of the granulate, being recovered.

3 Claims, 1 Drawing Sheet

PROCESS FOR COOLING LIQUID MELT DURING THERMAL WASTE TREATMENT

TECHNICAL FIELD

The invention concerns a process for solidifying liquified materials during thermal waste treatment.

BACKGROUND ART

In thermal waste treatment by direct melting or during the melting down of residues such as, for example, ashes, cinders, contaminated metals, general firing residues, gasification residues, filter dusts and precipitation products, a highly heated, liquid melted phase occurs whose quantity, composition and viscosity depends upon the heterogeneous, continuously added refuse and cannot be predicted in advance.

The meltings are usually passed directly into a water bath for cooling, flowing out of a container for receiving the liquid melting into a lower water barrel, preferably as a thin stream of liquid.

The melting stream is burst apart on being dipped into the water tank by the heat energy contained in the melting, water being trapped in the particles which form. The outer parts of the particle become solid, forming a gas-impermeable isolating layer. But inside the particle the temperature is still so high that hydrogen and thus the cause of an oxyhydrogen gas explosion can form. If the melting additionally contains carbonaceous components which were not gasified, these can gasify in the melt particles. Further cooling of the particle compresses the gas trapped inside even more. Additional pressure can result in the explosion of oxyhydrogen gas.

If metals and mineral substances are present in the liquid melted phase, their separation on entering the water tank is incomplete, because other phases may also become entrapped in the irregular particles of varying size forming in the water tank. This mutual "phase contamination" also makes the intended recycling of the melted-down substances particularly difficult.

SUMMARY OF THE INVENTION AND ADVANTAGES

The present invention therefore addresses the problem of making a process available, with which the highly heated, melted liquid phases occurring during thermal waste treatment as a result of direct melting or the melting down of residues, particularly metals and minerals, can be cooled safety and the metals and minerals separated.

This problem is solved by a process for discharging liquid melted phases, heated to a high temperature, which occur during thermal waste treatment by direct melting or the melting down of residues. The process is characterized by the liquid melted phases being sprayed into a jet of coolant with a high rate of flow and cooled until they solidify and are thus passes to a water bath as a granulate.

BRIEF DESCRIPTION OF THE DRAWING

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
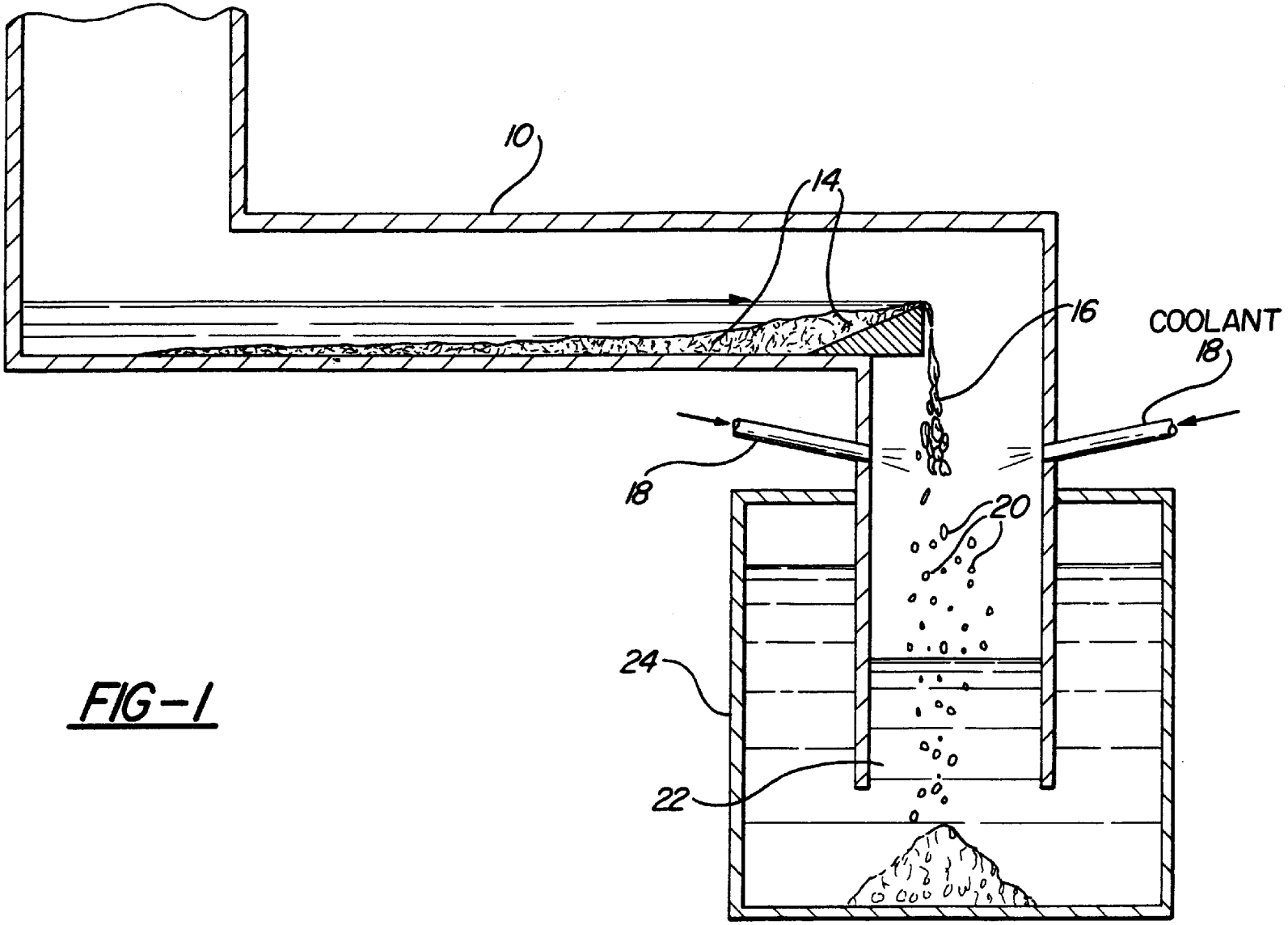
FIG. 1 is schematic view of an implementation of the subject invention.

Due to the fact that the liquid melted phases from a container 10 for receiving the liquid melting 14 in the form of a preferably thin jet flow, or ribbon, of liquid flow 16 into a jet 18 of coolant with a high rate of flow and are thus cooled until they solidify, a granulate structure 20 of relatively uniform granule size initially arises, thus avoiding the production of coarse grains which are difficult to cool. Via the high flow rate of the coolant jets 18, the meltings 16 are initially "blasted apart" into smaller droplets 20, which harden completely and rapidly as the result of a favorable volume/surface ratio, before they reach the water bath 22. The formation of hydrogen as the cause of an oxyhydrogen gas explosion and the trapping of supercritical quantities of water as the cause of an explosive energy release induced by shock waves are thus prevented. The better heat-conductivity of the metallic phase in comparison with that of the mineral substances gives rise to a higher rate of solidification and produces phase separation during cooling as a result of the rapid and significant change in the surface conditions.

The granulate 20 thus formed is passed into a catching tank 24, temperature-stabilized by circulating liquid 22, where it gives off the residual heat and is then discharged by means of suitable devices.

The substances present in the granulate 20, of course in a mixture but separated, as metals and minerals can then for example, to the extent that individual particles are concerned, be separated magnetically and applied to a new use.

The medium for the cooling jet 18, which can advantageously take the form of a ring of nozzles, is preferably water. But it is also possible to use gas for this purpose, preferably cooled inert gas.

The heat liberated as the meltings solidify is used to stabilize the temperature of the water bath 22 by liquid circulation, the residual heat given off by the granulate 20 being recovered.

When water is employed as the coolant jet 18, the coolant of the cooling jet 18 can itself be integrated without difficulty into the recovery of heat, if it is passed into the water bath 22 together with the granulate 20.

What is claimed is:

1. A method for treating the discharge (14) of high temperature liquid melted phases, comprising the steps of;

forming a thin flow of melted phases, spraying a jet of coolant at a high rate of flow to disperse the melted phases into solid granulate, and depositing the solid granulate in a water bath for further cooling.

2. A method as set forth in claim 1, further defined as circulating the water in the water bath to maintain the water bath at a predetermined temperature.

3. A method as set forth in claim 1, further including cooling the water bath and recovering the heat extracted from the water bath.

* * * * *